US009396845B2

(12) United States Patent
Nagahashi

(10) Patent No.: US 9,396,845 B2
(45) Date of Patent: Jul. 19, 2016

(54) COAXIAL ELECTRIC WIRE AND METHOD FOR MANUFACTURING THE SAME

(71) Applicant: Yazaki Corporation, Tokyo (JP)

(72) Inventor: Mitsuharu Nagahashi, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/481,009

(22) Filed: Sep. 9, 2014

(65) Prior Publication Data

US 2014/0374135 A1 Dec. 25, 2014

Related U.S. Application Data

(63) Continuation of application No. PCT/JP2013/056741, filed on Mar. 12, 2013.

(30) Foreign Application Priority Data

Mar. 14, 2012 (JP) ..... 2012-057194

(51) Int. Cl.
*H01B 7/00* (2006.01)
*H01B 13/016* (2006.01)
(Continued)

(52) U.S. Cl.
CPC ..... *H01B 13/0162* (2013.01); *H01B 7/04* (2013.01); *H01B 9/04* (2013.01); *H01B 11/1834* (2013.01); *H01B 13/016* (2013.01);
(Continued)

(58) Field of Classification Search
USPC ..... 174/28, 102 R, 106 R, 108, 109, 110 R, 174/113 R, 120 R
See application file for complete search history.

(56) References Cited

U.S. PATENT DOCUMENTS 2,286,759 A * 6/1942 Patnode ..... B05D 3/12 118/DIG. 18
2,288,900 A * 7/1942 Gits ..... H01B 13/202 174/28

(Continued)

FOREIGN PATENT DOCUMENTS

CN 2377658 Y 5/2000
CN 201655417 U 11/2010

(Continued)

OTHER PUBLICATIONS

International Search Report dated Jun. 4, 2013, issued for PCT/JP2013/056741.

(Continued)

*Primary Examiner* — William H Mayo, III
(74) *Attorney, Agent, or Firm* — Locke Lord LLP

(57) ABSTRACT

A coaxial electric wire with an inner conductor, an inner insulating layer covering a periphery of the inner conductor, an outer conductor covering a periphery of the inner insulating layer, and an outer insulating layer covering a periphery of the outer conductor, where the inner insulating layer is made of a first insulating tube having an elongated cylindrical shape and an insulation performance, the outer insulating layer is made of a second insulating tube having an elongated cylindrical shape and an insulation performance, the outer conductor is made of a conductive tube having an elongated cylindrical shape and conductivity, the coaxial electric wire is manufactured by inserting the inner conductor into the first insulating tube, inserting the first insulating tube into the conductive tube, and inserting the conductive tube into the second insulating tube.

2 Claims, 1 Drawing Sheet

(51) Int. Cl.

| | |
|---|---|
| ***H01B 9/04*** | (2006.01) |
| ***H01B 7/04*** | (2006.01) |
| ***H01B 11/18*** | (2006.01) |
| *H01B 13/06* | (2006.01) |

(52) U.S. Cl.
CPC ..... *H01B 13/0165* (2013.01); *H01B 13/062* (2013.01); *Y10T 29/49123* (2015.01)

(56) References Cited

U.S. PATENT DOCUMENTS

| | | | | | |
|---|---|---|---|---|---|
| 3,399,449 | A * | 9/1968 | McGean | H01B 13/225 | 228/148 |
| 4,161,704 | A * | 7/1979 | Schafer | H01B 13/0006 | 29/600 |
| 4,372,043 | A * | 2/1983 | Cookson | H02G 5/063 | 156/48 |
| 4,376,920 | A * | 3/1983 | Smith | H01B 11/10 | 174/105 R |
| 5,107,076 | A | 4/1992 | Bullock et al. | | |
| 5,210,377 | A | 5/1993 | Kennedy et al. | | |
| 5,515,603 | A * | 5/1996 | Ziemek | H01B 13/2633 | 174/107 |
| 6,323,420 | B1 * | 11/2001 | Head | F16L 7/00 | 138/103 |
| 6,417,454 | B1 * | 7/2002 | Biebuyck | H01B 11/1826 | 174/106 R |
| 6,989,486 | B2 * | 1/2006 | Lovoi | A61N 5/1001 | 174/110 R |
| 7,355,123 | B2 * | 4/2008 | Kimura | H01B 11/1834 | 174/102 R |
| 7,439,447 | B2 | 10/2008 | Galey et al. | | |
| 7,569,767 | B2 * | 8/2009 | Moe | B23K 13/025 | 174/102 R |
| 2005/0115738 | A1 * | 6/2005 | Yamaguchi | H01B 11/1813 | 174/102 R |
| 2005/0230145 | A1 * | 10/2005 | Ishii | H01B 11/1834 | 174/113 AS |

FOREIGN PATENT DOCUMENTS

| | | | |
|---|---|---|---|
| DE | 102008037969 | A1 | 2/2010 |
| EP | 0938102 | B1 | 9/2005 |
| JP | H11-273466 | A | 10/1999 |
| JP | 2007-042521 | A | 2/2007 |
| JP | 2008-543017 | A | 11/2008 |
| JP | 2010-257777 | A | 11/2010 |

OTHER PUBLICATIONS

Office Action dated Jun. 19, 2015, issued for the Australian patent application No. 2013233262.
Office Action dated on Nov. 4, 2015 issued for corresponding Chinese Patent Application No. 201380014428.5.
Office Action mailed on May 17, 2016 issued for corresponding Japanese Patent Application No. 2012-057194.

* cited by examiner

COAXIAL ELECTRIC WIRE AND METHOD FOR MANUFACTURING THE SAME

TECHNICAL FIELD

The present invention relates to a coaxial electric wire and a method for manufacturing the coaxial electric wire, in particular, the coaxial electric wire having at least an inner conductor, an inner insulator covering a periphery of the inner conductor, an outer conductor covering a periphery of the inner insulator, and an outer insulator covering a periphery of the outer conductor, and the method for manufacturing this coaxial electric wire.

BACKGROUND ART

Conventionally, various electronic devices are mounted on a vehicle or the like, and a wiring harness (electric wire) is arranged therein for transmitting electric power, a control signal, and the like. Further, in recent years, a vehicle running with a driving force of a motor driven by electric power of a battery such as a hybrid vehicle or an electric vehicle becomes common. In such a battery-driven vehicle, DC current outputted from the battery is converted into AC current of a specific frequency by an inverter, and a motor is driven by this AC current. As a power line which transmits DC current by connecting the battery with the inverter in this way, two-core wire corresponding to two positive and negative electrodes is used (for example, see PTL 1).

The electric wire (cable) described in PTL 1 includes: two insulated core wires made by conductors such as single wire or twisted wire covered by an insulator; an inclusion provided around these insulated core wires; a suppressing wound tape wound around the two insulated core wires and the inclusion; and a sheath covering an outer periphery of the suppressing wound tape. This electric wire can be light-weighted and environmentally friendly by properly selecting components of the inclusion. However, the electric wire, in which two insulated core wires are arranged in parallel like this electric wire, is easy to be bent in a direction of which bending axis is an arranging direction of the two insulated core wires, but is difficult to be bent in a direction of which bending axis is perpendicular to the arranging direction among two directions perpendicular to an extending direction of the electric wire. Therefore, because flexibility (non-flexibility) of the electric wire is directional (anisotropic), inconvenience is generated such that a wiring path is regulated and a wiring distance (wire length) becomes long when the electric wire is arranged in a vehicle or the like, because the electric wire cannot be bent freely. Further, a diameter of the sheath is more than twice a diameter of the insulated core wire, and a useless space is generated in the sheath. Thereby, the diameter of the sheath becomes larger, and a large space is necessary for wiring.

In contrast, as an electric wire, the electric wire (coaxial wire) made by coaxially and sequentially laminating a center conductor, an insulator coveting an outer periphery of the center conductor, an outer conductor covering an outer periphery of the insulator, and an outer cover covering an outer periphery of the outer conductor is used. Because the coaxial wire is isotropic, wiring flexibility can be improved, and a wiring space can be reduced by shrinking an outer diameter of the electric wire. As a method for manufacturing a coaxial wire, it is proposed that the method includes the steps of: producing a center conductor from the stranded wire; forming an insulator around the center conductor by extruding molten resin; providing an outer conductor composed of such as twisted wire, helical stranded wire, or metal tape around this insulator; and forming an outer cover around this outer conductor by extruding molten resin (for example, see PTL 2).

CITATION LIST

Patent Literature

[PTL 1]
JP, A, 2007-42521
[PTL 2]
JP, A, 2010-257777

SUMMARY OF INVENTION

Technical Problem

However, in the conventional method for manufacturing an electric wire as described in PTL 2, because the insulator and the outer cover are made by extruding molten resin, management of molten resin temperature and management of extrusion speed become complicated and a control means for controlling them is needed. Therefore, there is a problem that a manufacturing apparatus becomes complicated and large-sized. Further, an advanced manufacturing management is necessary for forming an outer cover homogeneously and stably with respect to the outer cover composed of various materials such as braided wire, helical twisted wire, or metal tape. Therefore, in this regard, the manufacturing apparatus becomes further complicated.

Accordingly, an object of the present invention is to provide a coaxial cable and a method for manufacturing the coaxial cable able to form a homogenous and stable insulating layer while simplifying a manufacturing apparatus.

Solution to Problem

For solving the above problems, according to a first aspect of the present invention, there is provided a coaxial electric wire at least including:

an inner conductor;

an inner insulating layer covering a periphery of the inner conductor;

an outer conductor covering a periphery of the inner insulating layer; and an outer insulating layer covering a periphery of the outer conductor, wherein the inner insulating layer is made of a first insulating tube having an elongated cylindrical shape and an insulation performance, the outer insulating layer is made of a second insulating tube having an elongated cylindrical shape and an insulation performance, and the outer conductor is made of a conductive tube having an elongated cylindrical shape and conductivity.

According to a second aspect of the present invention, there is provided the coaxial electric wire as described in the first aspect, wherein the outer conductor works as a shield member for electromagnetically shielding the inner conductor, or works as an energizing member for energizing together with the inner conductor as a pair.

According to a third aspect of the present invention, there is provided the coaxial electric wire as described in the first or second aspect, further including:

an exterior member covering a periphery of the outer insulating layer, said exterior member being made of a flexible tube having an elongated cylindrical shape and flexibility.

According to a fourth aspect of the present invention, there is provided a method for manufacturing a coaxial electric wire, said coaxial electric wire at least including:

an inner conductor;

an inner insulating layer covering a periphery of the inner conductor;

an outer conductor covering a periphery of the inner insulating layer; and an outer insulating layer covering a periphery of the outer conductor, wherein the inner insulating layer is made of a first insulating tube having an elongated cylindrical shape and an insulation performance, the outer insulating layer is made of a second insulating tube having an elongated cylindrical shape and an insulation performance, the outer conductor is made of a conductive tube having an elongated cylindrical shape and conductivity, said method including the steps of:

inserting the inner conductor into the first insulating tube;

inserting the first insulating tube into the conductive tube; and inserting the conductive tube into the second insulating tube.

According to a fifth aspect of the present invention, there is provided the method for manufacturing a coaxial electric wire as described in the fourth aspect including the steps of:

inserting the inner conductor into the first insulating tube to make a first component;

inserting the first component into the conductive tube to make a second component; and inserting the second component into the second insulating tube.

Advantageous Effects of Invention

According to the invention as described in the first aspect, the inner insulating layer is made of a first insulating tube having an elongated cylindrical shape and an insulation performance, the outer insulating layer is made of a second insulating tube having an elongated cylindrical shape and an insulation performance, the outer conductor is made of a conductive tube having an elongated cylindrical shape and conductivity. Therefore, the coaxial electric wire can be manufactured by inserting the inner conductor into the first insulating tube, inserting the first insulating tube into the conductive tube, and inserting the conductive tube into the second insulating tube. Therefore, the cylindrical first insulating tube and the second insulating tube may be previously manufactured; thereby homogenous and stable inner and outer insulating layers can be formed. Further, the coaxial electric wire can be manufactured by using a manufacturing apparatus having a relatively easy structure (press-in apparatus) without using an extrusion molding apparatus requiring a complex manufacturing management. Further, because the outer conductor is made of a conductive tube, its thickness and shapes of inner and outer walls can be stable, thereby an insertion (press-in) operation of the first insulating tube into this conductive tube and an insertion (press-in) operation of this conductive tube into the second insulating tube can be conducted smoothly.

According to the invention as described in the second aspect, because the outer conductor works as a shield member or as an energizing member, this coaxial electric wire can be used as a shield wire or as a two-core signal line or a power line. Incidentally, when the outer conductor works as the shield member, the conductive tube only may be made by proper material and have a proper thickness and the like required for electromagnetically shielding the inner conductor. In contrast, when the outer conductor works as the energizing member, for example, DC current is energized by connecting the inner conductor with a positive electrode of a DC power source, and connecting the outer conductor with a negative electrode of the DC power source, or AC current is energized by connecting the inner and outer conductors respectively with an AC power source. In this case, material and a sectional area of each of the inner and outer conductors may be properly adjusted so that electric resistances of the inner and outer conductors may be the same.

According to the invention as described in the third aspect, the exterior member covering a periphery of the outer insulating layer is made of a flexible tube having an elongated cylindrical shape and flexibility. Therefore, by inserting the second insulating tube into the flexible tube, a coaxial cable having an exterior member can be manufactured using the manufacturing apparatus having the relatively simple structure similar to the above and with the similar procedures. Further, when an insertion (press-in) operation of the second insulting tube into the flexible tube is conducted using the manufacturing apparatus similar to the above, working efficiency can be increased in comparison with a case that the electric wire is manually inserted into the external member. Further, a clearance between the flexible tube and the second insulating tube can be reduced. Therefore, an outer diameter size of the electric wire including the exterior member can be reduced, and the miniaturization of the wiring space is further promoted.

According to the invention as described in the fourth aspect, similar to the above, homogenous and stable inner and outer insulating layers can be formed. Further, the coaxial electric wire can be manufactured by using a manufacturing apparatus having a relatively easy structure (press-in apparatus). Further, because the outer conductor is made of a conductive tube, an insertion (press-in) operation of the first insulating tube into this conductive tube and an insertion (press-in) operation of this conductive tube into the second insulating tube can be conducted smoothly.

According to the invention as described in the fifth aspect, the first component is made, then the second component is made by inserting the first component into the conductive tube, and then the coaxial electric wire is made by inserting the second component into the second insulating tube. Thus, the components are inserted sequentially from an inside of the coaxial electric wire toward an outside of the coaxial electric wire, and thereby insertion operations of the components can be conducted further smoothly.

DESCRIPTION OF EMBODIMENTS

A coaxial electric wire according to an embodiment of the present invention will be explained with reference to FIGS. 1 and 2. A coaxial electric wire 1 according to this embodiment is an electric wire having an exterior member provided on, for example, a hybrid vehicle, an electric vehicle, or the like. Here, an inverter for controlling the driving of a motor, or controlling the regeneration of the motor, and a battery for charging electric power, or supplying electric power to the inverter are mounted on the hybrid vehicle or the electric vehicle. Further, the coaxial electric wire 1 is used as a power line for connecting the inverter with the battery via an underfloor of the vehicle and energizing both positive and negative DC currents.

Figure 1:
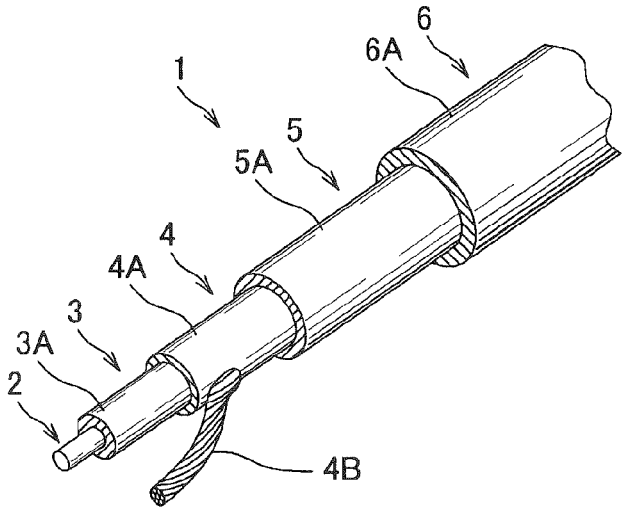
FIG. 1 is a perspective view showing a coaxial electric wire according to an embodiment of the present invention.

As shown in FIG. 1, the coaxial electric wire 1 includes: an inner conductor 2 for transmitting, for example, positive current; an inner insulating layer 3 covering a periphery of the inner conductor 2; an outer conductor 4 covering a periphery of the inner insulating layer 3 and transmitting, for example, negative current; an outer insulating layer 5 covering a periphery of the outer conductor 4; and an exterior member 6 covering a periphery of the outer insulating layer 5.

The inner conductor 2 is made of a single wire or of a twisted wire made by twisting a plurality of single wires. As the material of the inner conductor 2, for example, copper, annealed copper wire made of copper alloy, tin-plated copper wire, nickel-plated copper wire, aluminum wire made of aluminum and aluminum alloy, or the like can be used. Incidentally, because the inner conductor 2 is pressed into the inner insulating layer 3 as described above, preferably, the inner conductor 2 is made of a single wire having a small peripheral face friction resistance.

The outer conductor 4 is made of a conductive tube (pipe) 4A having conductivity and an elongated cylindrical shape. As the material of the conductive tube 4A, for example, copper, annealed copper pipe made of copper alloy, tin-plated copper pipe, nickel-plated copper pipe, aluminum pipe made of aluminum and aluminum alloy, or the like can be used. Preferably, such a conductive tube 4A has the same electric resistance as the inner conductor 2. When the conductive tube 4A is made of the same material as the inner conductor 2, sectional areas of them are the same. Further, a branch wire 4B is fixed to the outer conductor 4 for connecting to an electrode of the inverter or the battery. Incidentally, the conductive tube 4A of the outer conductor is not limited to the pipe but may be a braided wire.

The inner insulating layer 3 and the outer insulating layer 5 are made of thermoplastic elastomer resin material and respectively composed of a first insulating tube 3A and a second insulating tube 5A both having an elongated cylindrical shape and an insulation performance. As the thermoplastic elastomer resin material with which the first insulating tube 3A and the second insulating tube 5A are made, various types are well-known, and high-polymer material such as polyvinyl chloride resin, polyethylene resin, or polypropylene resin is properly selected. Further, according to the types of the resin material, plasticizer added material (polyvinyl chloride resin), and cross-linked material (polyvinyl chloride resin, polyethylene resin) are used.

The exterior member 6 is made of a flexible tube 6A having an elongated cylindrical shape and flexibility. As the flexible tube 6A, for example, a resin-made tube, a resin-made corrugated tube having a corrugated-shaped portion and a straight portion, and a metallic pipe can be used. This exterior member 6 protects the inner conductor 2, the inner insulating layer 3, the outer conductor 4, and the outer insulating layer 5. Further, the exterior member 6 is fixed to a floor of a vehicle or the like with a proper fixture in a bent state. Further, the exterior member 6 may be made of conductive material, and may form a shield layer by connecting to the ground. Incidentally, when a resin-made corrugated tube is used as the exterior member 6, shield layers may be provided on inside and outside of the corrugated tube.

Figure 2:
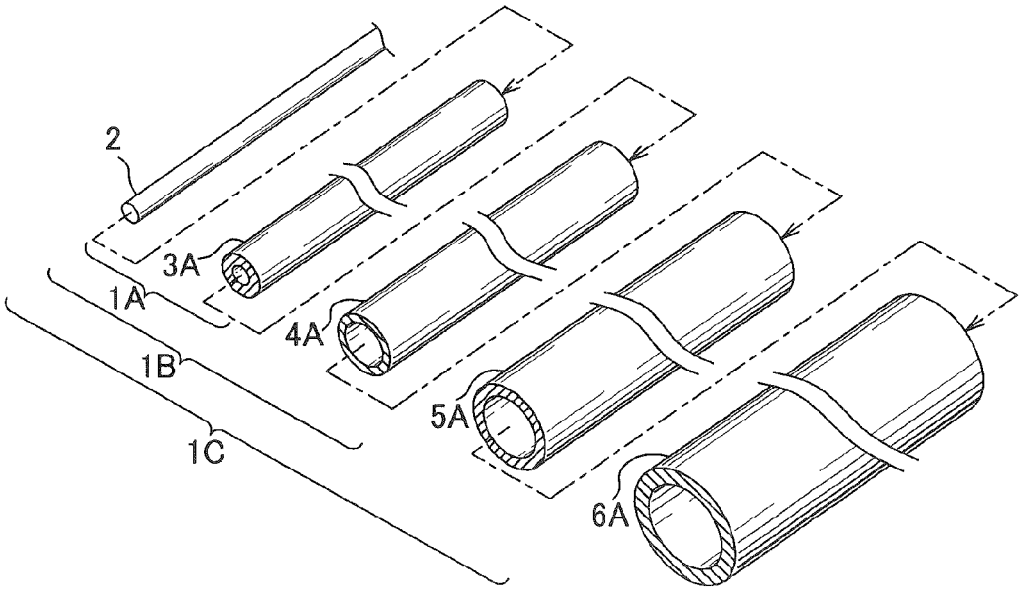
FIG. 2 is an explanatory view showing a manufacturing procedure of the coaxial electric wire.

As shown in FIG. 2, the above coaxial electric wire 1 is manufactured by inserting the inner conductor 2 into the first insulating tube 3A to make a first component 1A, then inserting the first component 1A into the conductive tube 4A to make a second component 1B, then inserting the second component 1B into the second insulating tube 5A to make a third component 1C, and then inserting the third component 1C into the flexible tube 6A. Namely, the inner conductor 2, the cylindrical first insulating tube 3A, the conductive tube 4A, the second insulating tube 5A, and the flexible tube 6A are previously manufactured, and sequentially inserted from inner members toward the outer members. Here, an inner diameter of the first insulating tube 3A is substantially the same as an outer diameter of the inner conductor 2, an inner diameter of the conductive tube 4A is substantially the same as an outer diameter of the first insulating tube 3A, an inner diameter of the second insulating tube 5A is substantially the same as an outer diameter of the conductive tube 4A, and an inner diameter of the flexible tube 6A is substantially the same as an outer diameter of the second insulating tube 5A.

Specifically, each outer member is supported in a straight shape or a curve shape having a relatively small curvature, and an inner member is pressed in and inserted into the outer member from one end of the outer member. Upon pressing in, one or both of the outer and inner members may be rotated about a longitudinal axis. Further, a lubricant agent such as grease may be applied on an inner periphery of the outer member or an outer periphery of the inner member. Further, the outer member may be heated by a proper heater, and thereby after the inner diameter of the outer member is increased, the inner member may be inserted. Further, prior to the insertion of the inner member, a diameter expansion member for expanding an inner diameter of the outer member may be inserted, and then the inner member may be inserted following the diameter expansion member. In this way, when all the members are inserted coaxially, the manufacturing of the coaxial electric wire 1 in which the inner conductor 2, the inner insulating layer 3, the outer conductor 4, the outer insulating layer 5, and the exterior member 6 are integrated is finished. Further, in respective combinations of the inner conductor 2 and the inner insulating layer 3, the inner insulating layer 3 and the outer conductor 4, and the outer conductor 4 and the outer insulating layer 5, when the inner member is formed longer than the outer member, and an end of the inner member is projected upon inserting, the peeling of the coaxial electric wire 1 after manufacturing can be omitted, the waste of material can be reduced, and the efficiency of wiring operation can be improved.

According to the above embodiment, the coaxial electric wire 1 can be manufactured by previously manufacturing the cylindrical first insulating tube 3A, the conductive tube 4A, the second insulating tube 5A, and the flexible tube 6A, and by inserting the members from the inner conductor 2 toward an outside sequentially. Therefore, the coaxial electric wire 1 can be manufactured with a manufacturing apparatus (press-in apparatus) having a relatively simple structure without using an extrusion molding apparatus requiring a complex manufacturing management. In particular, when the conductive tube 4A composing the outer conductor 4 is used, because an inner periphery and an outer periphery of the conductive tube 4A can be formed smoothly, the press-in operation of the first component 1A into the conductive tube 4A, and the press-in operation of the second component 1B into the second insulating tube 5A can be smoothly conducted. Further, because the outer diameter size of the coaxial electric wire 1 can be minimized, the flexibility of the wiring route can be improved, the wiring space can be reduced, and the efficiency of the wiring operation can be increased. Further, when the members are closely abutted on each other (in particular, the outer insulating layer 5 and the exterior member 6), the heat from the heated inner conductor 2 by energizing or the heat from the outer conductor 4 is transmitted to the exterior member 6, and radiated from the exterior member 6, thereby the cooling effect can be improved.

Incidentally, the above embodiment only displays a typical embodiment of the present invention, and the present invention is not limited to the embodiments. Namely, various modifications can be made within a scope of the present invention.

For example, the coaxial electric wire 1 of the above embodiment is provided with the exterior member 6. However, the exterior member 6 may be omitted, or the other insulating layer may be provided instead of the exterior member 6. Further, in the above embodiment, an example in which the coaxial electric wire 1 is used as the power line connecting the inverter with the battery in a hybrid vehicle or the like is explained. However, the coaxial electric wire 1 of the present invention is not limited to the power line connecting the inverter and the battery, and further not limited to the power line. The coaxial electric wire 1 can be used for connecting arbitrary devices with each other. Further, in the above embodiment, an example in which the outer conductor 4 is used as the energizing member is explained. However, the present invention is not limited to this. The outer conductor 4 may be used as a shield member for electromagnetically shielding the inner conductor 2. Further, in the above embodiment, the coaxial electric wire 1 provided with a pair of conductors composed of the inner conductor 2 and the outer conductor 4 is explained. However, the coaxial electric wire 1 may be provided with one or more conductors in addition to the inner conductor 2 and the outer conductor 4. Further, each of the inner insulating layer 3 and the outer insulating layer 5 is not limited to a single layer, and may be provided with a plurality of insulating tubes.

REFERENCE SIGNS LIST

1 coaxial electric wire
2 inner conductor
3 inner insulating layer
3A first insulating tube
4 outer conductor
4A conductive tube
5 outer insulating layer
5A second insulating tube
6 exterior member
6A flexible tube

The invention claimed is:

1. A method for manufacturing a coaxial electric wire, said coaxial electric wire at least including:

an inner conductor;

an inner insulating layer covering a periphery of the inner conductor;

an outer conductor covering a periphery of the inner insulating layer; and an outer insulating layer covering a periphery of the outer conductor, wherein the inner insulating layer is made of a first insulating tube having an elongated cylindrical shape and an insulation performance, the outer insulating layer is made of a second insulating tube having an elongated cylindrical shape and an insulation performance, the outer conductor is made of a conductive tube having an elongated cylindrical shape and conductivity, said method comprising the steps of:

previously producing the first insulating tube having an inner diameter substantially the same as an outer diameter of the inner conductor, the conductive tube having an inner diameter substantially the same as an outer diameter of the first insulating tube, and the second insulating tube having an inner diameter substantially the same as an outer diameter of the conductive tube;

inserting the inner conductor into the first insulating tube;

inserting the first insulating tube into the conductive tube; and inserting the conductive tube into the second insulating tube.

2. The method for manufacturing a coaxial electric wire as claimed in claim 1 comprising the steps of:

inserting the inner conductor into the first insulating tube to make a first component;

inserting the first component into the conductive tube to make a second component; and inserting the second component into the second insulating tube.

* * * * *